US006418693B2

(12) United States Patent
Ballard

(10) Patent No.: US 6,418,693 B2
(45) Date of Patent: Jul. 16, 2002

(54) FLOORING ASSEMBLY AND FASTENER THEREFOR

(75) Inventor: James S. Ballard, Santa Clara, CA (US)

(73) Assignee: Ballard International Distributing Co., Santa Clara, CA (US)

( * ) Notice: Subject to any disclaimer, the term of this patent is extended or adjusted under 35 U.S.C. 154(b) by 0 days.

(21) Appl. No.: 09/843,719

(22) Filed: Apr. 30, 2001

Related U.S. Application Data

(62) Division of application No. 09/244,983, filed on Feb. 4, 1999, now Pat. No. 6,237,295.

(51) Int. Cl.[7] ..... E04F 15/00

(52) U.S. Cl. ..... 52/589.1; 52/591.5; 52/509; 52/489.1

(58) Field of Search ..... 52/489.1, 489.2, 52/509, 510, 512, 550, 582.1, 589.1, 592.1, 591.5, 391

(56) References Cited

U.S. PATENT DOCUMENTS 2,317,428 A * 4/1943 Anderson ..... 52/509
2,817,125 A * 12/1957 Johns ..... 52/512
4,227,355 A * 10/1980 Wendt ..... 52/64
4,255,914 A * 3/1981 Seipos ..... 52/483
4,272,938 A * 6/1981 Seipos ..... 52/509
5,660,016 A * 8/1997 Erwin et al. ..... 52/483.1
5,953,878 A * 9/1999 Johnson ..... 52/582.2

* cited by examiner

*Primary Examiner*—Carl D. Friedman
*Assistant Examiner*—Jennifer I. Thissell
(74) *Attorney, Agent, or Firm*—Arent Fox Kintner Plotkin & Kahn

(57) ABSTRACT

A flooring assembly and fastener therefor comprises flooring planks, preferably made of recycled lumber, and a clip fastener arranged between opposing longitudinal edges of the planks. The planks, in one embodiment, use tongue and groove construction. The clip is Z-shaped in cross section, one end portion of the clip catching the groove of a plank with the other end portion acting as a base for fastening to the joist. The clip fasteners are spaced along each joint and adjacent joints to retain the planks on the joists while permitting the planks to expand and contract at rates different than the joists themselves.

10 Claims, 2 Drawing Sheets

FLOORING ASSEMBLY AND FASTENER THEREFOR

This application is a division of application No. 09/244,983 filed Feb. 4, 1999, now U.S. Pat. No. 6,237,295.

FIELD OF THE INVENTION

The present invention is directed to a flooring assembly and fastener therefor and, in particular, to recycled plastic lumber decking and unitary clips to retain the decking in a stable and level manner on a plurality of horizontal joists.

BACKGROUND OF THE INVENTION

The present invention relates to an innovative flooring assembly and method, as well as several embodiments of a unitary fastener clip used to secure the flooring assembly to a plurality of horizontal support members, such as joists, so as to construct a platform, patio or a raised deck. This flooring assembly and fastener clip find particular utility by providing homeowners and building contractors with a relatively simple, secure and reliable means to construct a platform or a deck with a minimum number of component parts, and without specialized tools or expertise. The preferred embodiment of the flooring assembly employs recycled plastic lumber as the flooring component, which promotes the conservation of resources and the environment.

In the prior art, various fasteners have been proposed to retain flooring or decking in place, none of which approach the simplicity, economy and ease of use of the present invention. For instance, U.S. Pat. No. 5,660,016 to Erwin et al. discloses a foam-filled extruded decking plank and decking attachment system. This system includes clamps to hold down blocks which are secured onto a structure that supports the planks. The blocks permit relative motion between the planks. U.S. Pat. No. 4,599,842 to Counihan discloses a fastening system for fastening planar sections such as flooring boards to a base surface. The system includes fastening strips that interlockingly engage in a set of grooves cut in the ends of the boards. While the system of Erwin et al. recognizes that joist and decking fabricated from different construction materials may expand or contract at differing rates, this system is rather complex and especially adapted for extruded decking. In light of these complexities, a need has developed to provide an improved system for assembling flooring or decking planks which uses fewer components parts, is easier to assemble and is less expensive. In response to this need, the present invention provides an assembly and a fastener therefor which is simple but effective in securely retaining flooring planks to a support structure such as joists.

SUMMARY OF THE INVENTION

Accordingly, it is a first object of the present invention to provide consumers and building contractors with a relatively cost effective, secure and low maintenance flooring assembly, particularly for recycled plastic lumber.

Another object of the present invention is to provide an improved, easily-manufactured and cost-effective unitary fastener clip to securely retain flooring or decking in place.

A related object of the present invention is to provide a unitary fastener clip what will securely connect a series of flooring planks so that they are maintained flat and level with one another, while allowing the individual planks to expand and contract longitudinally according to weather and atmospheric condition.

A further object of the present invention is to provide a method if installing flooring using interconnecting flooring and the inventive unitary flooring fastener, with a minimum number of necessary components, and without specialized tools or expertise.

To achieve these objects and in accordance with the purposes of the invention, as embodied and broadly described herein, the present invention is directed to a flooring assembly comprising: a plurality of elongated flooring planks, wherein each of the elongated flooring planks has on opposing ends at least one of a tongue-containing first longitudinal edge and a groove-containing second longitudinal edge. This flooring assembly is arranged on a plurality of supporting members so that the tongue-containing first longitudinal edge of a first elongated flooring plank engages the groove-containing second longitudinal edge of a second flooring plank.

In addition, a plurality of clip units are utilized, wherein each of the clip units is fastened to the supporting members and are arranged between the elongated flooring planks. A distal end portion of each clip positioned between a lower face of said tongue-containing first longitudinal edge of the first elongated flooring plank and an upper face of the groove-containing second longitudinal edge of said second flooring plank. Each of the clip units exerts a force normal to the lower face of the tongue-containing first longitudinal edge of said first plank and the upper face of the groove-containing second longitudinal edge of a second flooring plank so as to retain said elongated flooring planks to the supporting members latitudinally, while permitting the elongated flooring to expand and contract longitudinally.

BRIEF DESCRIPTION OF THE DRAWINGS

Reference is now made to the drawings of the invention wherein.

DESCRIPTION OF THE PREFERRED EMBODIMENTS

Figure 1:
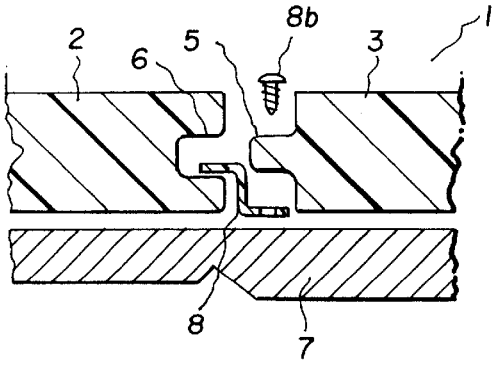
FIG. 1 is a sectional view of one embodiment of the inventive assembly in exploded form to show greater detail.
Figure 2:
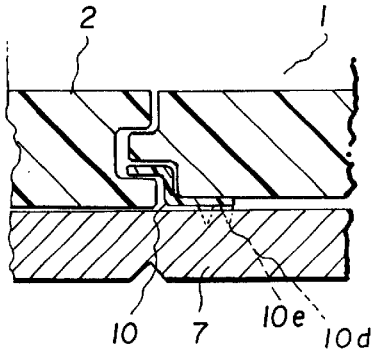
FIG. 2 shows the assembly of FIG. 1 in a partially assembled state.
Figure 3:
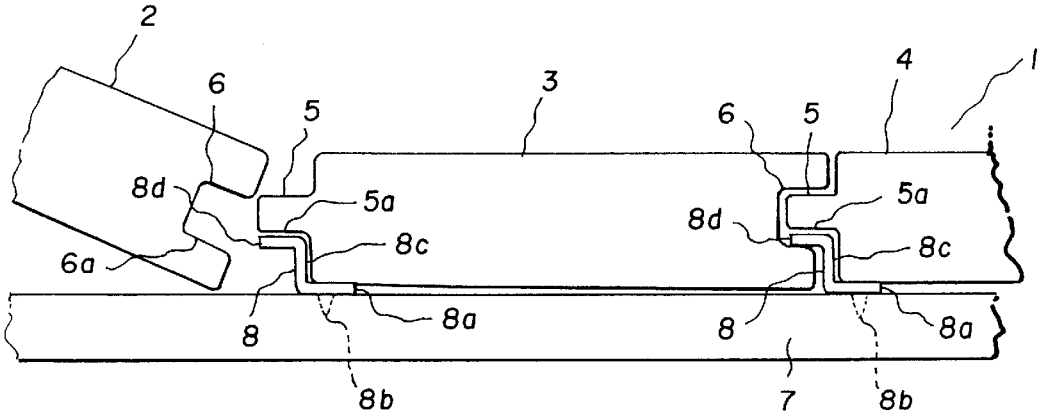
FIG. 3 shows a perspective view of one embodiment of the inventive fastener.

The preferred embodiment of the inventive flooring assembly and fastener unit of the present invention is shown in FIGS. 1, 2 and 3 and is represented by reference numeral 1. The flooring assembly includes a plurality of elongated flooring planks 2, 3, and 4. These elongated flooring planks 2, 3 or 4 may be constructed of an extruded recycled plastic material, or other suitable flooring materials commonly used in construction. Each of the elongated flooring planks 2, 3 and 4, have on opposing ends at least one of a tongue-containing first longitudinal edge 5 and a groove-containing second longitudinal edge 6. The elongated flooring planks 2, 3 and 4 are arranged along a plurality of supporting members 7, so that the tongue-containing first longitudinal edge 5 an elongated flooring plank 3 or 4 engages the groove-containing second longitudinal edge 6 of a second flooring plank 2 or 3. The supporting members 7 may take the form of joists and may be constructed of wood.

A plurality of clip units 8 are used to fasten the plurality of flooring planks 2, 3or 4 to the supporting members 7. Each of said clip units 8 may have a z-shape in vertical cross section. The base 8*a* of each of the clip units 8 is fastened to a supporting member 7 and is arranged between the flooring planks, 2, 3, or 4, with a leg 8*c* extending vertically therefrom. In an alternative embodiment, each clip unit 8 is comprised of a pair of prongs 10*a* and 10*c* extending downward from the base portion 8*a* of the clip units 8. The pair of prongs 10*b* and 10*c* engage the supporting member 7 when the clip units 8 are fastened thereto.

A free, distal end portion 8*d* of each clip unit 8 is attached perpendicular to the vertical leg 8*c* and parallel to the base 8*a*. The distal end portion 8*d* is positioned between a lower face 5*a* of the tongue-containing first longitudinal edge 5 of elongated flooring planks 3 or 4 and an upper face 6*a* of the groove-containing second longitudinal edge 6 of second flooring planks 2 or 3. Each of the clip units 8 used to construct flooring assembly 1 is usually fastened to each of the supporting members 7 in a spaced apart relationship.

When the flooring is fully assembled as shown in FIGS. 1, 2 and 3, each of the clip units 8 exerts a force perpendicular to the lower face 5*a* of the tongue-containing first longitudinal edge 5 of the first plank 3 or 4 and to the upper face 6*a* of the groove-containing second longitudinal edge 6 of the second plank 2 or 3, so as to retain the elongated flooring planks 2, 3 or 4 to said supporting members 7 latitudinally, while permitting the elongated flooring planks 7 to expand and contract longitudinally according to usage, weather or atmospheric conditions.

Referring now to FIGS. 1, 3, 6 and 7, the preferred embodiment of the 8 is described. In FIGS. 1 and 3, the clip units 8 used to fasten the elongated flooring planks 2, 3 and 4 to a support surface 7 are comprised of a base 8*a* and at least one fastening means 8*b* to secure the base 8*a* to support surface 7. A leg 8*c* extends vertically from the base 8*a*. A free, distal end portion, 8*d* extends perpendicular to the leg 8*c*, and is spaced apart from, and parallel to, the base 8 and is sized to engage a groove-containing second longitudinal edge 6 of a plurality of flooring planks 3 or 4 to retain the flooring planks 3 or 4 against the support surface 7.

Again referring to FIGS. 1, 2, 6 and 7, the clip unit 8 is fastened to the supporting member 7 by a screw 8*b*, which is inserted through a single aperture 8*e* in the base 8*a*, through which the screw 8*b* engages the support member 7 and the base 8*a*. The single aperture 8*e* in the base 8*a* of clip unit 8 may be offset from the center point represented by the intersection of broken reference lines 12, so as to be positioned in close proximity to leg 8*c*. This is an important feature of the present invention, as it prevents clip 8 from bending upward during use, which allows a smaller clip 8 to be used to secure the elongated flooring 2, 3 and 4 to the supporting members 7. This feature may also be incorporated into the alternative embodiments of the clip units 9 and 10 shown in FIGS. 4 and 5.

The single aperture 8*e* may be countersunk 8*f* in order to allow the head of the screw 8*b* to rest flush and level with the upper surface of the base 8*a*. This feature allows the elongated flooring planks 2, 3 and 4 to lie flat and level with each other on the supporting members 7, thus enhancing the utility and aesthetic desirability of the flooring assembly 1.

Figure 4:
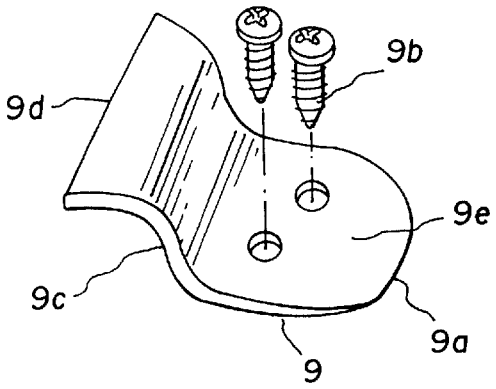
FIG. 4 shows a perspective view of a second embodiment of the inventive fastener.
Figure 5:
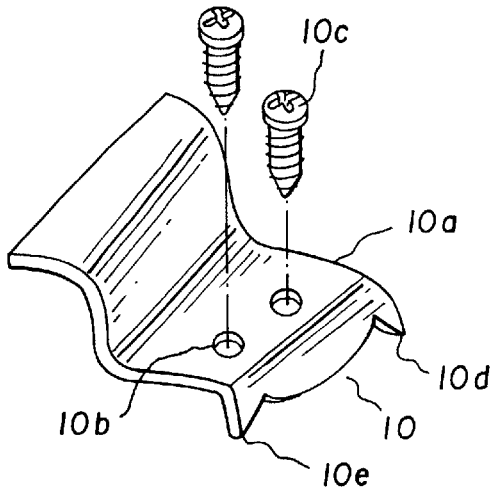
FIG. 5 shows a perspective view of a third embodiment of the inventive fastener.
Figure 6:
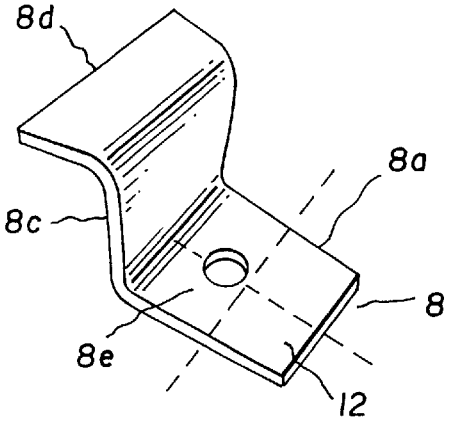
FIG. 6 shows a connection between adjacent planks.
Figure 7:
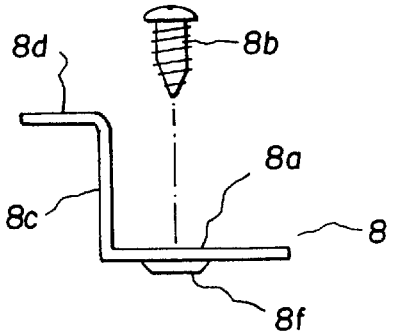
FIG. 7 shows a side view of the inventive fastener.

In alternative embodiments of the invention shown in FIGS. 2, 4 and 5, the clip units 9 and 10 include fastening means comprised of two apertures 9*e* and 10*b* arranged adjacent to one another in the base 9*a* and 10*a*, and through which two screws 9*b* and 10*c* engage the support surface 7 and the base 9*a* and 10*a*. Each of the two apertures may be countersunk (not shown), in order to allow the heads of the screws 9*b* and 10*c* to rest flush and level with the upper surface of the base 9*a* and 10*a*. This allows the elongated flooring planks 2, 3 and 4 to lie flat on the supporting members.

Referring now to FIG. 5, the clip unit 10 includes an additional fastening means comprised of two prongs 10*d* and 10*e* attached to opposing sides of the base 10*a* and extending downward therefrom. As shown in FIG. 2, the prongs 10*d* and 10*e* are inserted into the material of the supporting member 7 in order to prevent movement of the clip unit 8.

The present invention also includes a method, shown in FIG. 3, of constructing a flooring assembly I which comprises the steps of providing a plurality of elongated floor planks 2, 3 and 4 with opposing longitudinal edges 5 and 6, clip units 8 and supporting members 7 and fastening the clips 8 units in spaced apart relationship along the supporting members 7 to support the plurality of elongated floor planks 2, 3 and 4. This method also includes the steps of arranging the elongated floor planks 2, 3 and 4 on the supporting members 7 in a side-by-side relationship to create a substantially flat, level flooring.

The preferred embodiment of this method also requires the positioning of the clip units 8 between the opposing longitudinal edges 5 and 6 of the adjacent elongated floor planks 2, 3 and 4 to retain these floor planks 2, 3 and 4 on the supporting members.

In alternative embodiments of this method, shown in FIG. 2, clip unit 8 may include means, such as prongs 10*d* and 10*e*, which securely affix the clip unit 8 to supporting member 7. As a result, the clip units 8 are fastened in such a way as to further prevent rotation thereof.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A clip for fastening planks to a support surface comprising a base, at least one fastening means to secure the base to the support surface, said fastening means having a recessed protrusion protruding from the base and capable of engaging the support surface, a leg extending from the base, and a free end portion extending from the leg, the free end portion vertically spaced from the base, extending in a single plane and sized to engage a groove of one of adjacently positioned planks to retain the planks against the support surface.

2. The clip as recited in claim 1, wherein the recessed protrusion is capable of receiving a screw having a head, the recessed protrusion having a shape so that the screw head will lay flush against the base and will not protrude from the base.

3. The clip as recited in claims 1, wherein the recessed protrusion is capable of receiving multiple screws.

4. The clip as recited in claim 1, wherein the recessed protrusion is conical in shape.

5. The clip as recited in claim 1, wherein the recessed protrusion protrudes from the base and is capable of engaging the support surface.

6. A flooring assembly comprising:

a) a plurality of elongated flooring planks, each of said elongated flooring plans having a plurality of opposing ends, one of said plurality of opposing ends having a tongue-containing first longitudinal edge and a second of said plurality of opposing ends having a groove-containing second longitudinal edge;

b) a plurality of supporting members, the plurality of said elongated flooring planks being arranged on said plurality of supporting members so that said tongue-containing first longitudinal edge of said one of said plurality of opposing ends of a first one of said elongated flooring planks cooperatively interconnects with said groove-containing second longitudinal edge of said second of said plurality of opposing ends of a second one of said elongated flooring planks;

c) a plurality of clip units, wherein each of said clip units is fastened to one of said supporting members and is arranged between two of said flooring planks, a distal end portion of each clip positioned between a lower face of said tongue-containing first longitudinal edge of said one of said plurality of opposing ends of a first elongated flooring plank and an upper face of said groove-containing second longitudinal edge of said one of said plurality of opposing ends of a second one of said elongated flooring planks;

d) wherein each of said clip units exerts a force perpendicular to said lower face of said tongue-containing first longitudinal edge of said one of said plurality of opposing ends of a first of said elongated flooring planks and to said upper face of said groove-containing second longitudinal edge of said second of said plurality of opposing ends of a second one of said elongated flooring planks; and wherein each of said plurality of clip units essentially consists of a base, at least one fastening means to secure said base to a support surface, a leg extending vertically from said base, and a free distal end portion extending from said leg; and wherein said fastening means has a recessed protrusion protruding from the base and capable of engaging the support surface.

7. The flooring assembly claimed in claim 6, wherein each of said clip units has a z-shape in vertical cross section.

8. The flooring assembly claimed in claim 6, wherein each of said flooring planks is constructed of an extruded recycled plastic throughout.

9. The flooring assembly claimed in claim 6, wherein each of said plurality of clip units is fastened to one of said supporting members in a spaced apart relationship.

10. The flooring assembly claimed in claim 6, wherein said supporting members are constructed of wood.

* * * * *